US005977919A

United States Patent [19]

Kudo et al.

[11] Patent Number: 5,977,919

[45] Date of Patent: Nov. 2, 1999

[54] TV ANTENNA APPARATUS FOR VEHICLES

[75] Inventors: Shigeki Kudo, Kawasaki; Hiroshi Endo, Tokyo; Masatoshi Saito, Machida, all of Japan

[73] Assignee: Harada Industry Co., Ltd., Tokyo, Japan

[21] Appl. No.: 09/114,098

[22] Filed: Jul. 13, 1998

[30] Foreign Application Priority Data

Jul. 14, 1997 [JP] Japan ..... 9-188421
Nov. 28, 1997 [JP] Japan ..... 9-328733

[51] Int. Cl.[6] ..... H01Q 1/32

[52] U.S. Cl. ..... 343/713; 343/711; 343/795

[58] Field of Search ..... 343/713, 711, 343/712, 795

[56] References Cited

U.S. PATENT DOCUMENTS 5,394,292 2/1995 Hayashida ..... 361/179

5,805,113 9/1998 Ogino et al. ..... 343/858

*Primary Examiner*—Don Wong
*Assistant Examiner*—Hoang Nguyen
*Attorney, Agent, or Firm*—Volpe and Koenig, P.C.

[57] ABSTRACT

A TV antenna apparatus for vehicles of the present invention includes a plurality of sheet antennas serving as an antenna element which is obtained by forming a foil having a specific pattern on a base sheet constituted of a flexible insulating film, adhering means for adhering the plurality of sheet antennas to respective positions of front and rear nonconductive members of a vehicle body, such as inner right and left sides of front and rear bumpers of nonconductive members of the vehicle body, and feeders for connecting the plurality of sheet antennas adhered by the adhering means, to a TV set in a four-channel diversity system.

11 Claims, 9 Drawing Sheets

TV ANTENNA APPARATUS FOR VEHICLES

BACKGROUND OF THE INVENTION

The present invention relates to a TV antenna apparatus for vehicles which is usually called a mast-less antenna apparatus having no masts protruded from the car body but a sheet antenna for receiving a TV broadcast wave.

Recently there have been great demands for the use of the mast-less antenna apparatus as a TV antenna apparatus for vehicles.

FIG. 21 is a view showing an example of a wideband TV antenna apparatus 20 conventionally used for receiving a TV broadcast wave. As shown in FIG. 21, the apparatus 20 includes a folded antenna element 21 obtained by folding a metal pipe with a diameter of about 10 mm like an oval or a loop. A feed section 23 is provided in the central part of the antenna element 21 and connected to a feeder 25, which is constituted of a coaxial cable, through a balun 24 (matching transformer for choosing between balanced and unbalanced lines).

The folded antenna element 21 is formed of a so-called rigid member, and its length is about 1300 mm and its width is about 50 mm when it is used in the VHF band (falling between 90 MHz and 222 MHz in Japan). Since the antenna element 21 so constituted is too large in size and rigid, it is not adapted to an object so well. For this reason, the antenna element 21 is not suitable to be used as a mast-less antenna apparatus which is mounted on a resin panel of a vehicle.

The antenna element 21 constituted as shown in FIG. 21 and used in the VHF band is not able to receive a radio wave of the UHF band with efficiency. In order to satisfactorily receive the radio wave of the UHF band as well as that of the VHF band, a small-sized antenna element for the UHF band, which is about one-fifth of the antenna element 21, has to be added and, in this case, in order to prevent the antenna element 21 for the VHF band and that for the UHF band from interfering with each other, a wave separator for separating the radio waves of both the antenna elements is needed.

As an example of the mast-less antenna apparatus, there is an antenna apparatus used for a windowpane of a vehicle. In this antenna apparatus, a thin, narrow, strip conductor provided on the rear window, is used as an antenna element.

The vehicle windowpane antenna apparatus is suitable as the mast-less antenna apparatus because no portions are greatly protruded from the car body. However, even though, for example, a four-channel space diversity reception method is adopted, no good space diversity effect can be obtained.

To obtain good space diversity effect, the antenna elements have to be arranged at intervals of about $\lambda/4$ ($\lambda$: wavelength). Assuming that the frequency f of received wave is 100 MHz, $\lambda/4$ is 75 cm. Thus, the antenna elements need to be arranged vertically and horizontally on the rear window of a vehicle (especially an automobile) at intervals of 75 cm. It is however physically difficult to arrange the antenna elements on the rear window in the same manner as described above.

The radio waves are coming from different directions every moment in accordance with the movement of the vehicle. Therefore, when the antenna elements of the vehicle windowpane antenna apparatus are formed on the rear window of the vehicle, they can favorably receive the wave coming from a direction perpendicular to the window surface, but not the waves falling upon the sides and front of the vehicle because they are obstructed by the car body.

BRIEF SUMMARY OF THE INVENTION

It is accordingly an object of the present invention to provide a TV antenna apparatus for vehicles including sheet antennas for receiving a TV broadcast wave. The TV antenna apparatus has the following advantages:

1) The antenna apparatus is small and light and can thus be easily mounted on a predetermined position of the inner side of a nonconductive member such as a resin-made bumper so as not to be projected outside.
2) The antenna apparatus is capable of obtaining good space diversity effect and directivity of all portions.
3) The antenna apparatus is simple in construction and able to receive both waves of VHF and UHF bands satisfactorily.

In order to attain the above object, the TV antenna apparatus for vehicles according to the present invention has the following constructions.

The other characteristic constructions will be clarified in the embodiment.

(1) A TV antenna apparatus for vehicles comprises a plurality of sheet antennas serving as an antenna element which is obtained by forming a foil having a specific pattern on a base sheet constituted of a flexible insulating film, adhering means for adhering the plurality of sheet antennas to respective positions of front and rear nonconductive members of a vehicle body, and feeders for connecting the plurality of sheet antennas adhered by the adhering means, to a TV set.

(2) In the TV antenna apparatus described in above (1), the sheet antennas are adhered to the inner surfaces of the right and left sides of the front and rear nonconductive members.

(3) A TV antenna apparatus for vehicles comprises four sheet antenna serving as an antenna element which is obtained by forming a foil having a specific pattern on a base sheet constituted of a flexible insulating film, adhering means for adhering the four sheet antennas to respective positions of front and rear nonconductive members of a vehicle body, and feeders for connecting the four sheet antennas adhered by the adhering means, to a TV set of a four-channel diversity system to allow reception of wave in the four-channel diversity system.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiment of the invention, and together with the general description given above and the detailed description of the preferred embodiment give below, serve to explain the principles of the invention.

DETAILED DESCRIPTION OF THE INVENTION (Embodiment)

Figure 1:
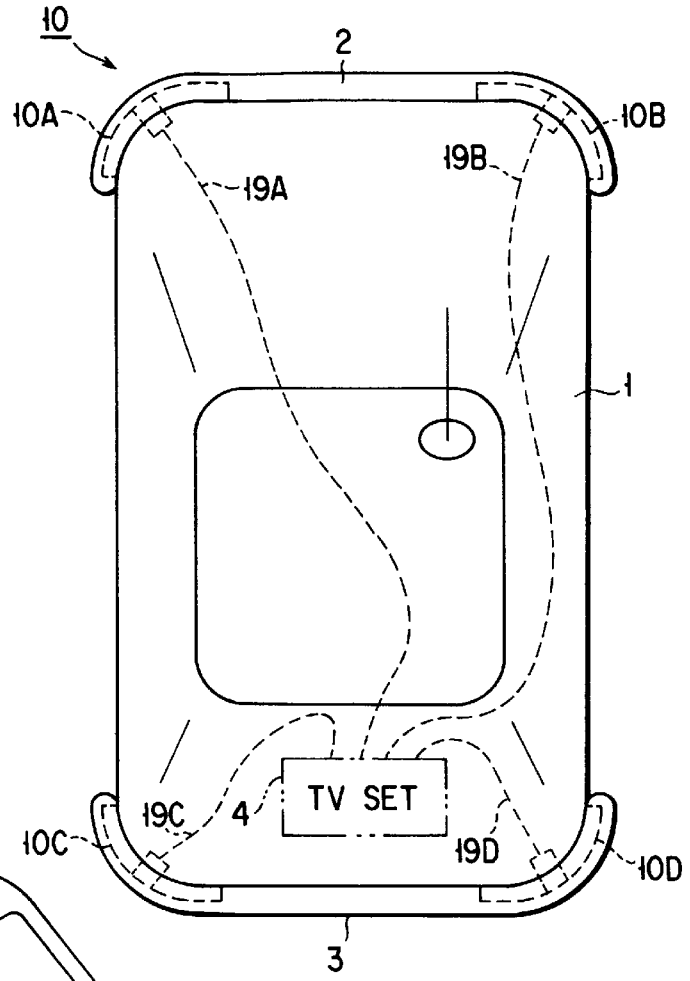
FIG. 1 is a schematic plan view of the structure of a TV antenna apparatus for vehicles according to an embodiment of the present invention, in which the sheet antennas are mounted on bumpers of a vehicle body constituted of nonconductive material.

FIG. 1 is a schematic plan view of a TV antenna apparatus 10 for vehicles according to an embodiment of the present invention, which is mounted on bumpers made of nonconductive materials.

Referring to FIG. 1, reference numeral 1 indicates a vehicle body, numeral 2 shows a front bumper, and numeral 3 denotes a rear bumper. Both the bumpers 2 and 3 are constituted of nonconductive materials such as resin. First and second sheet antennas 10A and 10B are adhered to the right and left sides of the front bumper 2, while third and fourth sheet antennas 10C and 10D are adhered to those of the rear bumper 3. The first to fourth sheet antennas 10A to 10D are connected to a four-channel diversity TV set 4 via feeders 19A to 19D of coaxial cables, respectively.

Figure 2:
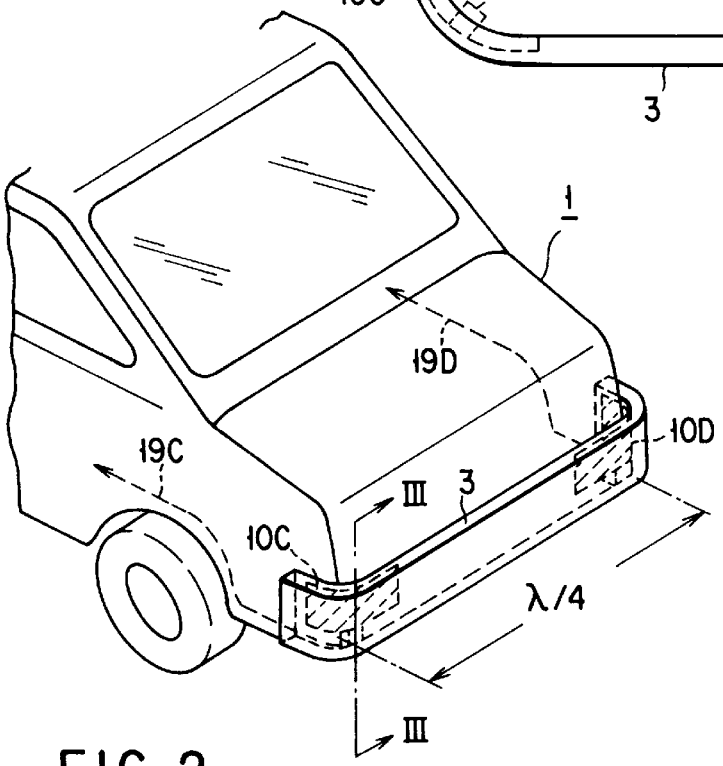
FIG. 2 is a view of the structure of a TV antenna apparatus for vehicles according to the embodiment of the present invention, in which the third and fourth sheet antennas are mounted on right and left sides of the rear bumper of the vehicle body.
Figure 3:
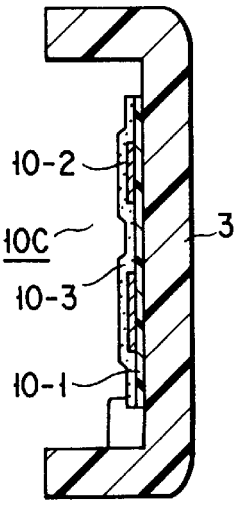
FIG. 3 is a cross-sectional view taken along line III—III of FIG. 2.

FIG. 2 is a schematic perspective view of the third and fourth sheet antennas 10C and 10D adhered to the right and left sides of the rear bumper 3 of the car body 1, and FIG. 3 is a cross-sectional view taken along line III—III of FIG. 2. As illustrated in FIGS. 2 and 3, the third and fourth sheet antennas 10C and 10D are adhered to the inner sides of the right and left corner portions of the rear bumper 3 using an adhesion means such as a double-faced tape. As shown in FIG. 2, when the wavelength of a received wave is A, the third and fourth sheet antennas 10C and 10D are adhered such that an interval between their feed sections is about $\lambda/4$.

As shown in FIG. 3, each of the sheet antennas includes an antenna element 10-2 having a specific pattern of foil formed on a base sheet 10-1, and the antenna element 10-2 is covered with a protection sheet 10-3.

Figure 4:
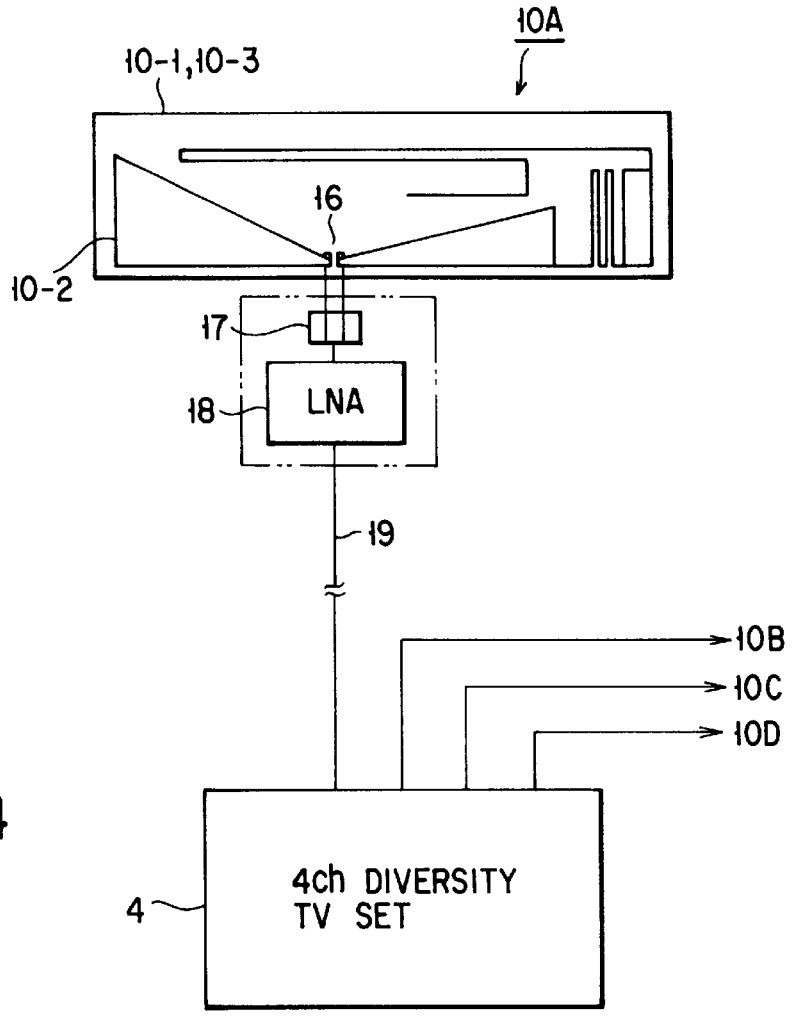
FIG. 4 is a schematic view of the structure of each of sheet antennas of the TV antenna apparatus according to the embodiment of the present invention.

FIG. 4 is a schematic view showing the constitution of the sheet antenna, taking the sheet antenna 10A as an example. The sheet antenna 10A has a balun 17 and a low noise amplifier (LNA) 18 (both of which will be described later) near a feed section 16 to feed an amplified reception signal to the four-channel diversity TV set 4 through a feeder 19. The other sheet antennas 10B to 10D are constituted in the same manner and connected to the TV set 4.

Figure 5:
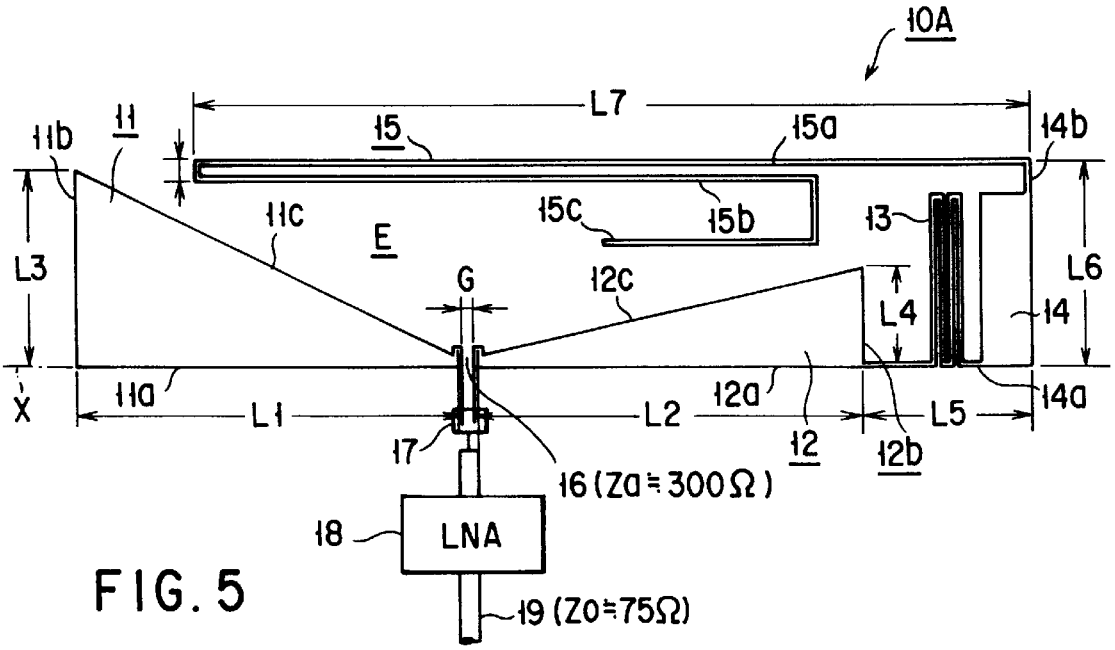
FIG. 5 is a plan view showing the structure of one of the sheet antennas of the TV antenna apparatus according to the embodiment of the present invention.

FIG. 5 shows the structure of the sheet antenna 10A in detail. Both the base sheet 10-1 and protection sheet 10-3 are excluded from FIG. 5. In FIG. 5, reference numerals 11 to 15 denote first to fifth antenna elements, respectively. Each of the antenna elements is formed of foil (e.g., copper foil) having a thickness of approximately 100 $\mu$m.

The first and second antenna elements 11 and 12 constitute a main antenna element section, and the third to fifth antenna elements 13 to 15 constitute a sub-antenna element section.

The first and second antenna elements 11 and 12 extend from a point of the feed section 16 and gradually broaden. Thus, the first and second antenna elements 11 and 12 are shaped like right-angled triangles having long sides 11*a* and 12*a* corresponding to the straight line X.

One end of the sub-antenna element section constituted of the third to fifth antenna elements 13 to 15 is connected to the tip portion of the second antenna element 12 of the main antenna element section, and the other end thereof is folded so as to make a U-turn along the straight line X. The other end of the sub-antenna element section guided into an area E in which oblique lines 11*c* and 12*c* of the first and second antenna elements 11 and 12. Hereinafter the first to fifth antenna elements 11 to 15 will be described in more detail.

The first antenna element 11 broadens gradually as it extends in one direction (leftward in FIG. 5) from the point of the feed section 16, and is shaped like a right-angled triangle having a long side 11*a* corresponding to the straight line X. In other words, the first antenna element 11 includes a long side 11*a* having a predetermined length (L1=190 mm), a short side 11*b* having a predetermined length (L3=95 mm), which is perpendicular to the long side 11*a*, and an oblique line 11*c* connecting both the long and short sides.

The second antenna element 12 broadens gradually at a smaller rate of change than the first antenna element 11 as it extends in a direction opposite to that of the first antenna element 11 (rightward in FIG. 5) from the point of the feed section 16, and is also shaped like a right-angled triangle having a long side 12*a* corresponding to the straight line X. In other words, the second antenna element 12 includes a long side 12*a* having a predetermined length (L2=190 mm), a short side 12*b* having a predetermined length (L4 =48 mm), which is perpendicular to the long side 12*a*, and an oblique line 12*c* connecting both the long and short sides.

There is a gap G of approximately 5 mm between the first and second antenna elements 11 and 12.

The third antenna element 13 is formed of a strip conductor the width of which is about 10 mm, and one end thereof is connected to the tip of the second antenna element 12, while the other end thereof is extended to a predetermined size in a zigzag pattern along the straight line X.

The fourth antenna element 14 is shaped like an oblong card and provided adjacent to the third antenna element 13. One end (one corner portion) 14*a* of the fourth antenna element 14 is connected to the other end of the third antenna element 13, and the other end 14*b* thereof (another corner portion diagonally opposite to the corner portion 14*a*) is connected to the fifth antenna element 15.

The oblong fourth antenna element 14 is arranged such that its outer edge (on the right-hand side in FIG. 5) is located at a predetermined distance (L5=84 mm) from the tip of the first antenna element 11 and its height has a predetermined value (L6=100 mm).

One end of the fifth antenna element 15 is connected to the other end 14*b* of the fourth antenna element 14, and the other end thereof is guided into the area E in which the oblique lines 11*c* and 12*c* of the first and second antenna elements 11 and 12 are opposed to each other, and extended meanderingly therein. The extended meanders include a distal end portion 15*a* having a predetermined length (L7=410 mm), an intermediate portion 15*b* and a tip portion 15*c*.

One end of the first antenna element 11 and that of the second antenna element 12 are coupled to each other, and the coupling portion serves as the feed section 16 (input impedance Za=about 300 Ω). The feed section 16 is connected to the TV set 4 (not shown in FIG. 5) through the balun 17 (matching transformer for choosing between balanced and unbalanced lines, impedance transformer ratio 1:4), the low noise amplifier (LNA) 18 and the feeder 19 (characteristic impedance $Z_0$=75Ω).

The above-described TV antenna apparatus 10 for vehicles has the following advantages. Since the first to fifth antenna elements 11 to 15 are each constituted of foil (copper foil) with a thickness of about 100 μm and formed on the base sheet 10-1 having flexibility, the sheet antennas 10A to 10D are extremely rich in flexibility. Therefore, the sheet antennas 10A to 10D are very fitted on the inner surface (including curved surface) of the resin-made bumpers 2 and 3 and, in other words, the sheet antennas 10A to 10D can be unified with the bumpers 2 and 3 almost completely.

Figure 21:
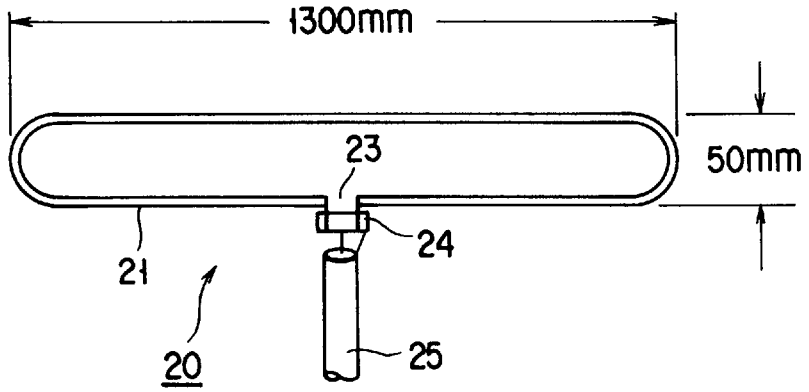
FIG. 21 (PRIOR ART)
FIG. 21 is a view of the structure of a prior art TV antenna apparatus for vehicles.

The whole length of the antenna elements (L1+L2+L5+G) is as short as 470 mm, which is 830 mm shorter than the whole length (1300 mm) of the prior art antenna element 21 shown in FIG. 21. Though the antenna elements are small, they can receive a TV broadcast wave in the UHF band (470 MHz to 770 MHz in Japan) as well as in the VHF band (90 MHz to 222 MHz in Japan), thereby achieving a small-sized, very-wide-band TV antenna apparatus.

Thus, the antenna elements can be adhered to, incorporated into or integrally molded with the resin-made bumpers 2 and 3 and nonconductive members used for part of the vehicle body 1 (a resin panel has recently been used frequently in order to lighten the body) such as a resin engine food, a resin trunk lid, and a resin rear spoiler.

Consequently, the antenna apparatus 10 can be mounted on the vehicle body 1 in such a manner that its existence cannot be recognized from outside the body 1. No special consideration has to be given to the design matching or harmony between the antenna apparatus 10 and vehicle body 1, and there are few cases where one steals or fools about the apparatus.

Since, in the antenna apparatus 10 of the present invention, the whole length of the antenna elements is only 470 mm and considerably shorter than that of the prior art antenna element, it can be easily mounted on a compact car, a light car, and the like. Moreover, the sheet antennas 10A to 10D are so arranged that two of them are adhered to both sides of the resin-made front bumper 2 and the other two are adhered to both sides of the rear bumper 3; therefore, the four-channel space diversity reception system for receiving TV broadcast waves can easily be achieved. For this reason, the TV broadcast wave reception performance can be improved dramatically in vehicles.

(Experiment)

FIGS. 6 to 13 are diagrams of results of measured antenna characteristics of each prototype of sheet antenna of the TV antenna apparatus for vehicles according to the above embodiment of the present invention.

Figure 6:
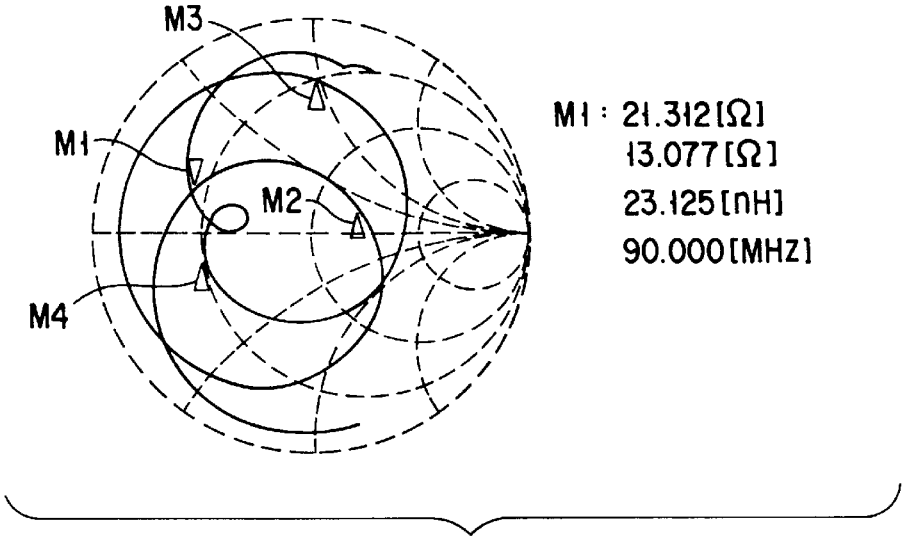
FIG. 6 is a diagram of curves of a Smith chart in the VHF band, showing experimental results of the TV antenna apparatus according to the embodiment of the present invention.
Figure 7:
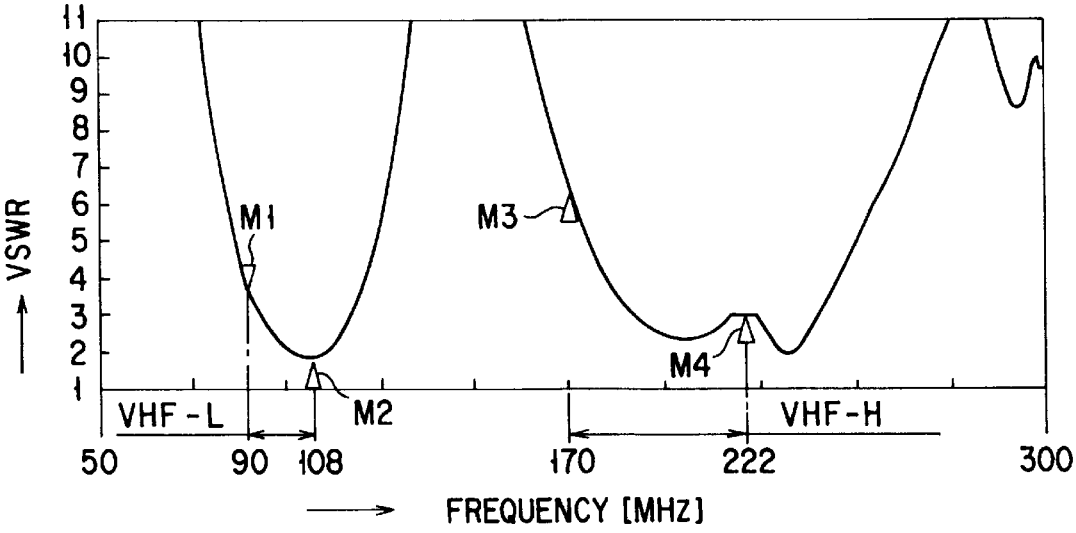
FIG. 7 is a diagram of curves of VSWR characteristics in the VHF band, showing experimental results of the TV antenna apparatus according to the embodiment of the present invention.
Figure 8:
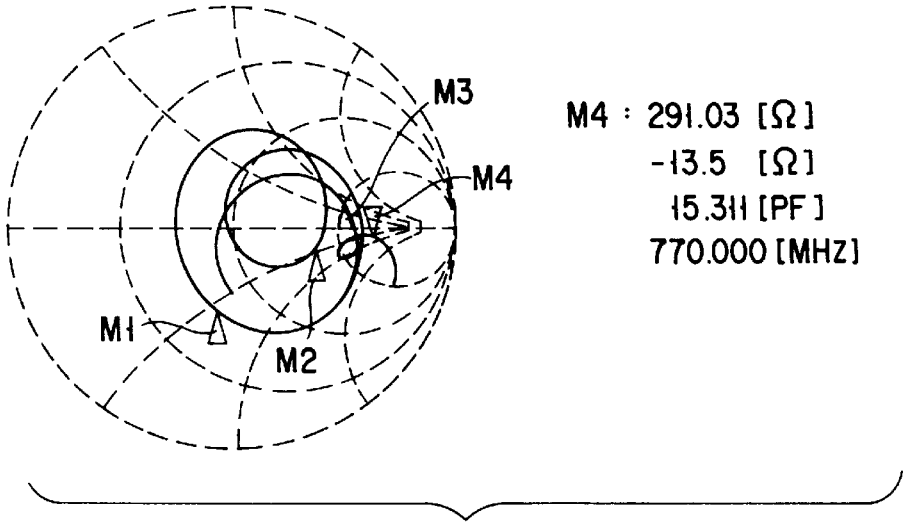
FIG. 8 is a diagram of curves of a Smith chart in the UHF band, showing experimental results of the TV antenna apparatus according to the embodiment of the present invention.
Figure 9:
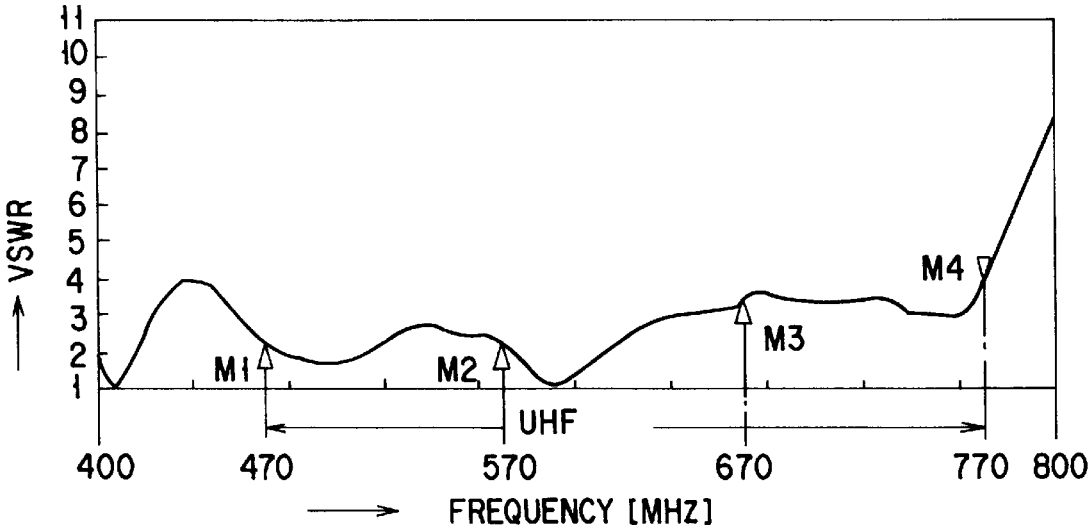
FIG. 9 is a diagram of curves of VSWR characteristics in the UHF band, showing experimental results of the TV antenna apparatus according to the embodiment of the present invention.
Figure 10:
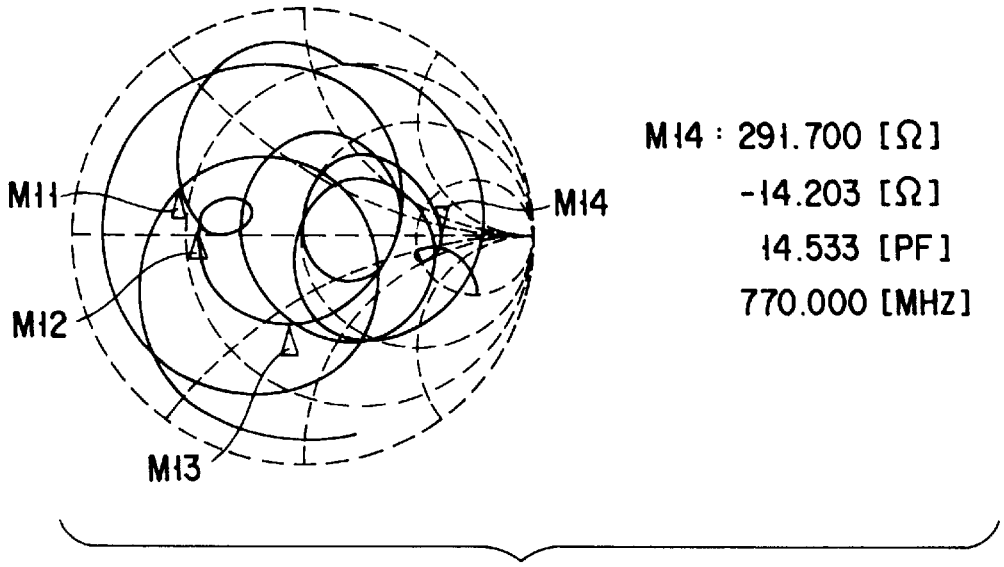
FIG. 10 is a diagram of curves of a Smith chart in the VHF and UHF bands, showing experimental results of the TV antenna apparatus according to the embodiment of the present invention.
Figure 11:
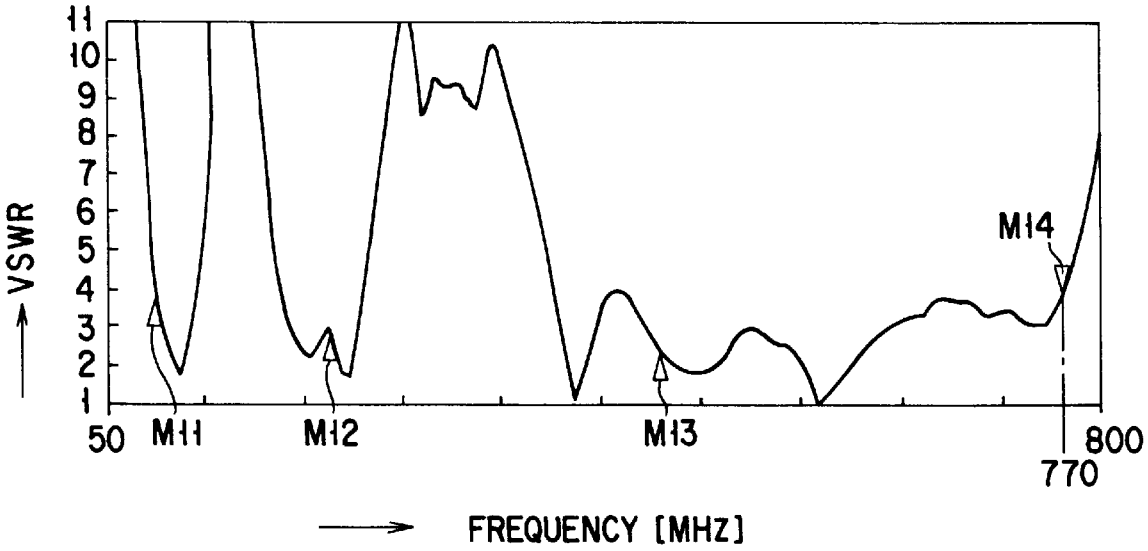
FIG. 11 is a diagram of curves of VSWR characteristics in the VHF and UHF bands, showing experimental results of the TV antenna apparatus according to the embodiment of the present invention.
Figure 12:
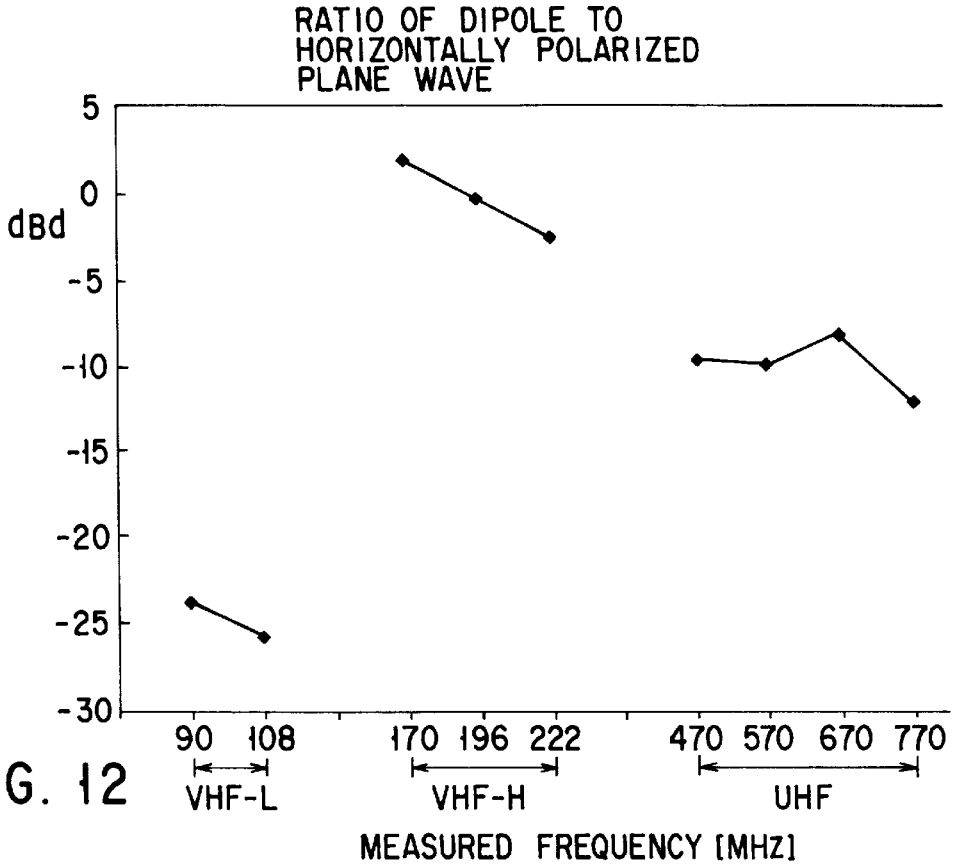
FIG. 12 is a view of dipole ratio (horizontally-polarized wave) of only an antenna, showing experimental results of the TV antenna apparatus according to the present invention.
Figure 13:
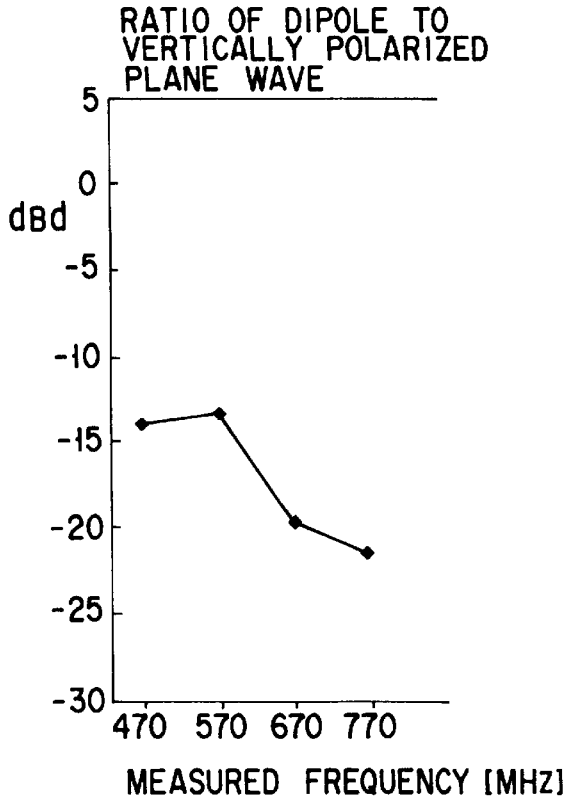
FIG. 13 a view of dipole ratio (vertically-polarized wave) of only an antenna, showing experimental results of the TV antenna apparatus according to the present invention.

FIGS. 6 and 7 are a Smith chart and a VSWR (voltage standing wave ratio) characteristic diagram in the VHF band, FIGS. 8 and 9 are a Smith chart and a VSWR characteristic diagram in the UHF band, FIGS. 10 and 11 are a Smith chart and a VSWR characteristic diagram in the VHF and UHF bands, and FIGS. 12 and 13 are graphs each showing a dipole ratio of the gain of only an antenna (without amplifier) to that (0 dBd) of the standard dipole.

As is apparent from FIGS. 6 to 11, the VSWR is 4 or smaller in the VHF-L band (90 MHz to 108 MHz in Japan) and the VSWR is 7 or smaller in the VHF-H band (170 MHz to 222 MHz), which means that the prototype of the sheet antenna can adequately be used practically. The VSWR is 4 or smaller throughout the UHF band (470 MHz to 770 MHz). It was therefore confirmed that the TV antenna apparatus 10 capable of satisfactorily receiving waves of both the VHF and UHF bands was achieved.

As shown in FIG. 12, the dipole ratio in the horizontally-polarized wave is slightly as low as −26 dBd in the VHF-L band (90 MHz to 108 MHz), but it is higher than −15 dBd in both the VHF-H band (170 MHz to 222 MHz) and the UHF band (470 MHz to 770 MHz), which fall within an allowable range of gain difference. In FIG. 13, the dipole ratio in the vertically-polarized wave is higher than −22 dBd in the UHF band (470 MHz to 770 MHz).

FIGS. 12 and 13 show the characteristics of an antenna alone (without amplifier). If the amplifier 18 is used as in the case where the antenna is actually used, the characteristics are improved more than those shown in the figures. It was confirmed that the gain was improved to such an extent as not to cause a trouble practically.

FIGS. 14 to 17 are views showing measured results of antenna characteristics (antenna's directivity in horizontally-polarized wave) when the above four prototypes of antenna sheet are mounted on right and left sides of the front and rear bumpers 2 and 3 of vehicle body 1.

Figure 14:
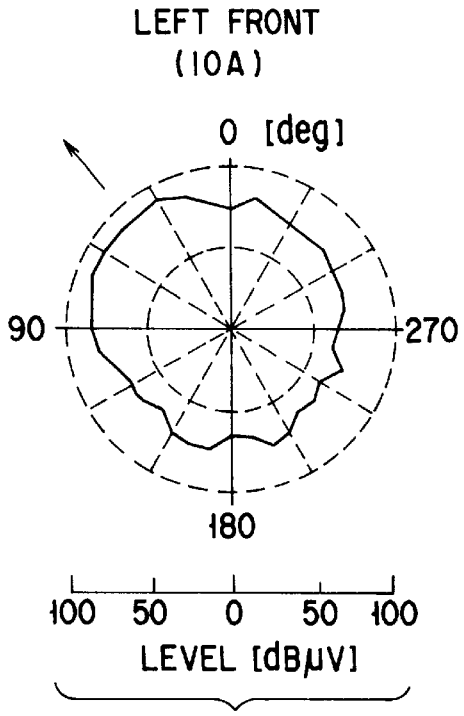
FIG. 14 is a view of measured results of directivity of the sheet antenna mounted on the left side of the front bumper of the vehicle body with respect to the horizontally-polarized wave in the TV antenna apparatus for vehicles according to the embodiment of the present invention.
Figure 15:
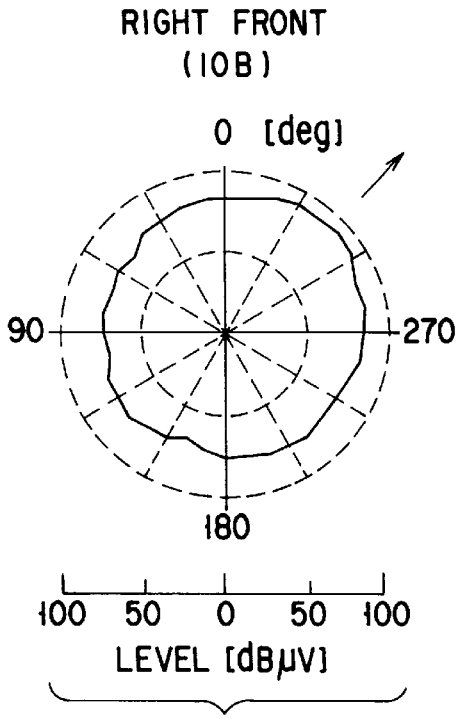
FIG. 15 is a view of measured results of directivity of the sheet antenna mounted on the right side of the front bumper of the vehicle body with respect to the horizontally-polarized wave in the TV antenna apparatus for vehicles according to the embodiment of the present invention.
Figure 16:
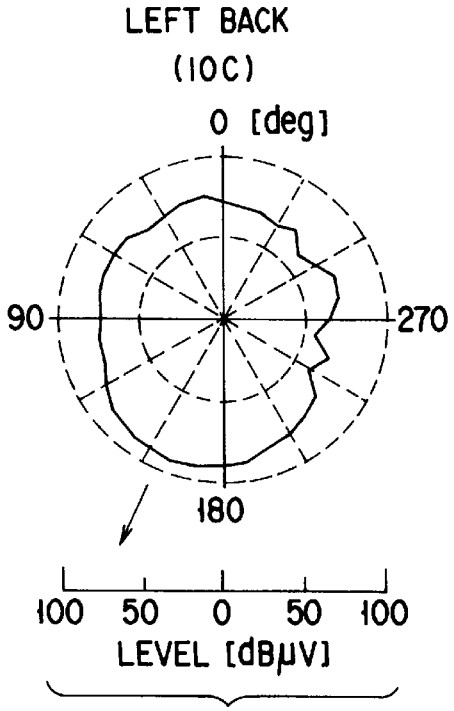
FIG. 16 is a view of measured results of directivity of the sheet antenna mounted on the left side of the rear bumper of the vehicle body with respect to the horizontally-polarized wave in the TV antenna apparatus for vehicles according to the embodiment of the present invention.
Figure 17:
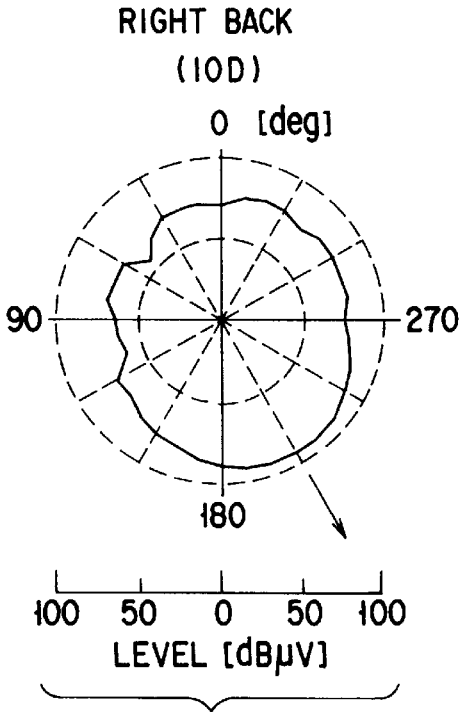
FIG. 17 is a view of measured results of directivity of the sheet antenna mounted on the right side of the rear bumper of the vehicle body with respect to the horizontally-polarized wave in the TV antenna apparatus for vehicles according to the embodiment of the present invention.

As illustrated in FIG. 14, the sheet antenna 10A adhered to the front left side of vehicle body 1 has directivity on the front left side of body 1 as indicated by the arrow, irrespective of the position of the antenna (in the right and left directions). Similarly, as shown in FIGS. 15 to 17, the sheet antenna 10B mounted on the front right side thereof has directivity on the front right side as indicated by the arrow, the sheet antenna 10C mounted on the rear left side thereof has directivity on the rear left side as indicated by the arrow, and the sheet antenna 10D adhered to the rear right side thereof has directivity on the rear right side as indicated by the arrow.

Figure 18:
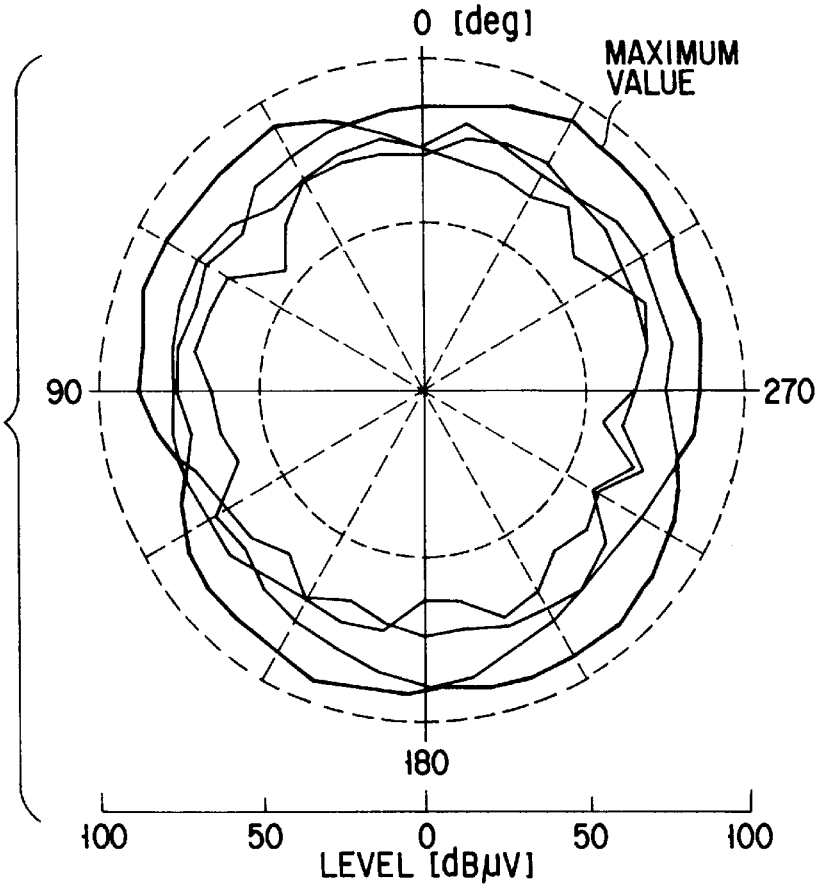
FIG. 18 is a diagram showing the experimental results of directivity of the four sheet antennas in a superimposed manner in the TV antenna apparatus according to the embodiment of the present invention.

FIG. 18 is a diagram showing the antenna characteristics of directivity of the sheet antennas 10A and 10D in a superimposed manner. In FIG. 18, the outermost curve shown by the heavy line as a MAX value represents the maximum one of reception levels at respective angles of the sheet antennas 10A to 10D each having directivity shown in FIGS. 15 to 17. If, therefore, four-channel diversity reception is performed using the antenna apparatus 10 of the present invention, it can be done at the above maximum level. Consequently, the overall directivity is almost uniform (non-directivity) in all directions of 360°, and the antenna apparatus 10 having a very-high-sensitivity characteristic of reception level can be obtained.

Figure 19:
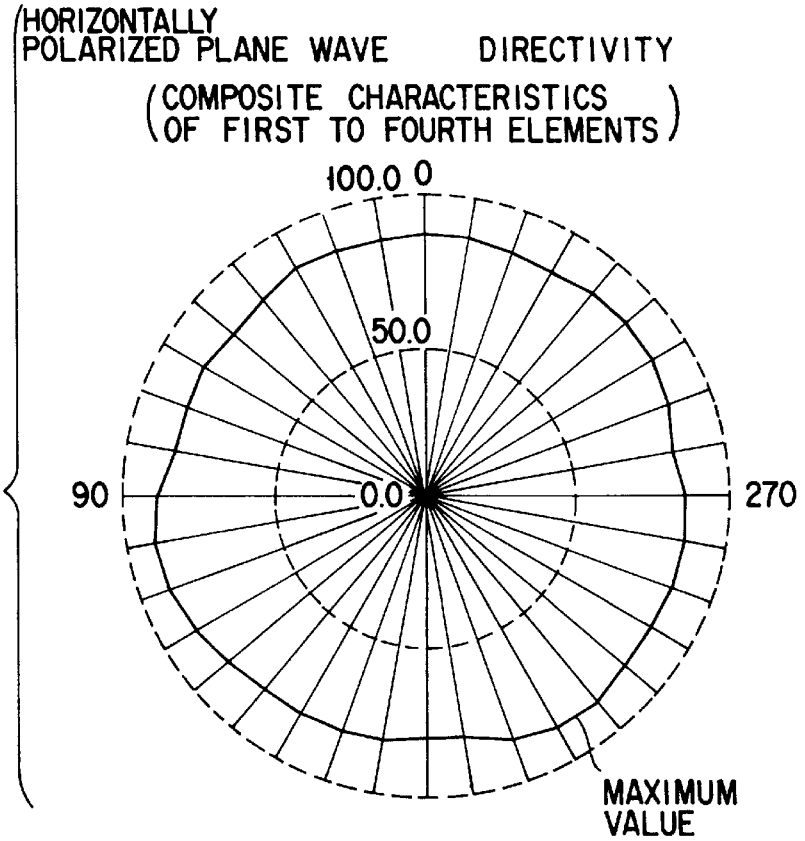
FIG. 19 is a diagram of results of direct measurements of overall directivity data of the above four sheet antennas in the TV antenna apparatus according to the embodiment of the present invention.

FIG. 19 is a view of results of direct measurements of overall directivity characteristics of the above four prototypes of antenna. In FIG. 19, the characteristic curve given as a MAX value, represents the maximum one of reception levels at respective angles of the four sheet antennas 10A to 10D when the four prototypes of antenna are mounted on both sides of the front and rear bumpers 2 and 3 of the body 1 and when the vehicle body 1 is rotated 360° in the oncoming direction of wave.

In theory, the overall directivity characteristic shown in FIG. 19 must be the same as that shown in FIG. 18 and, in fact, both the characteristics are very similar to each other.

In FIG. 19, the maximum reception level value MAX is 90.8 dB$\mu$, the minimum reception level value MIN is 80.8 dB$\mu$ and the average reception level value AVE is 86.0 dB$\mu$.

Figure 20:
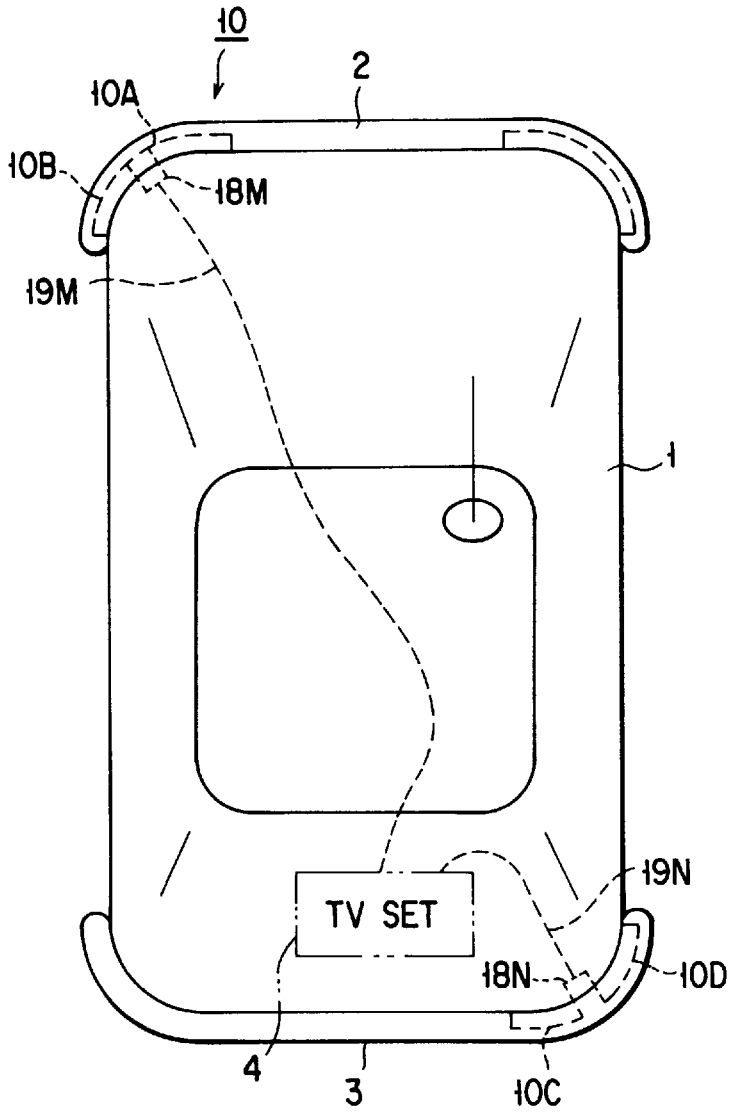
FIG. 20 is a schematic plan view showing a modification to the TV antenna apparatus for vehicles according to the embodiment of the present invention.

(Modifications)

i) At least part of the fifth antenna element 15 is formed in the same zigzag pattern as that of the third antenna element 13.

ii) The antenna elements are formed of foil other than copper foil such as aluminum.

iii) The length L2 of the second antenna element 12 is shorter than the length L1 of the first antenna element 11.

iv) The sheet antennas are mounted on the nonconductive members other than the bumpers.

v) As illustrated in FIG. 20, the two sheet antennas 10A and 10B are mounted on the left (or right) inner side of the nonconductive front bumper 2 of the vehicle body 1 and the other two sheet antennas 10C and 10D are mounted on the right (or left) inner side of the nonconductive rear bumper 3. The two sheet antennas 10A and 10B are connected to the TV set 4 through the low-noise amplifier 18M and the feeder 19M, while the other two sheet antennas 10C and 10D are connected to the TV set 4 through the low noise amplifier 18N and the feeder 19N.

(Merits of the Embodiment and Modifications)

The TV antenna apparatus for vehicles according to the embodiment and modifications has the following structures and advantages. [1] A TV antenna apparatus for vehicles according to the embodiment comprises a plurality of sheet antennas 10A to 10D serving as an antenna element 10-2 which is obtained by forming a foil having a specific pattern on a base sheet 10-1 constituted of a flexible insulating film, adhering means for adhering the plurality of sheet antennas 10A to 10D to respective positions of front and rear nonconductive members 2 and 3 of a vehicle body 1, and feeders 19A to 19D for connecting the plurality of sheet antennas 10A to 10D adhered by the adhering means, to a TV set 4.

In the above TV antenna apparatus, the sheet antennas 10A to 10D are rich in flexibility. These antennas can thus be easily adhered to the front and rear nonconductive members of the vehicle body 1, such as inner surfaces of resin-made bumpers 2 and 3, by the adhering means such as a double-faced tape in such a manner that they can be well fitted to the shape of the inner surfaces (including the curved surfaces) of the bumpers 2 and 3. That is, the sheet antennas 10A to 10D can be adhered such that they are almost completely integral with the bumpers as one component. Thus, a so-called mast-less antenna apparatus having no masts protruded from the vehicle body, can easily be attained.

The sheet antennas 10A to 10D can relatively easily be formed as an antenna element 10-2 by forming a foil having a specific pattern on the base sheet 10-1 by etching or the like.

[2] In the TV antenna apparatus described in above [1], the sheet antennas 10A to 10D are adhered to the inner surfaces of the right and left sides of the front and rear nonconductive members (bumper 2 and 3).

According to the above TV antenna apparatus, since the plurality of sheet antennas 10A to 10D are adhered to the inner sides of the members (bumpers) 2 and 3, they are neither projected from the vehicle body nor seen at all from outside, with the result that it cannot be recognized from outside whether the TV antenna apparatus is mounted or not. Consequently, the antenna apparatus has the advantage that the design of the vehicle body 1 is not lost and one is unlikely to steal or fool about the apparatus.

[3] A TV antenna apparatus for vehicles according to the embodiment comprises four sheet antenna 10A to 10D serving as an antenna element 10-2 which is obtained by forming a foil having a specific pattern on a base sheet 10-1 constituted of a flexible insulating film, adhering means for adhering the four sheet antennas 10A to 10D to respective positions of front and rear nonconductive members 2 and 3 of a vehicle body 1, and feeders 19A to 19D for connecting the four sheet antennas 10A to 10D adhered by the adhering means, to a TV set 4 of a four-channel diversity system to allow reception of wave in the four-channel diversity system.

In the foregoing TV antenna apparatus, the four sheet antennas 10A to 10D are mounted on their respective positions of the front and rear nonconductive members of a vehicle body 1 (for example, right and left inner sides of the front and rear bumpers 2 and 3). The four sheet antennas 10A to 10D can thus be arranged with a pitch of λ/4 between feed sections of the sheet antennas 10A to 10D. If, therefore, the four sheet antennas 10*a* to 10D are connected to a four-channel diversity TV set 4, they can receive waves in the four-channel space diversity reception system; thus, very good diversity reception effect can be expected.

[4] In the TV antenna apparatus described in above [1] or [3], each of the sheet antennas 10A to 10D includes main antenna elements 11 and 12 having a pair of foil patterns, which are extended along a straight line X in both directions from a point serving as a feed section 16 and broadened gradually and which are shaped like right-angled triangles having long sides 11*a* and 11*b* corresponding to the straight line X, and sub-antenna elements 13 to 15 one end of which is connected to a tip portion of one 12 of the main antenna elements, the other end of which is folded to make a U-turn along the straight line and guided into an area E in which oblique lines 11*c* and 12*c* of the antenna elements 11 and 12 are opposed to each other.

According to the TV antenna apparatus described above, one of the sub-antenna elements 13 to 15 is folded to make a U-turn and guided into a space of the main antenna elements. Therefore, a so-called space factor in the base sheet 10-1 is improved to make the apparatus compact, and the whole length (L1+L2+L5+G) of the antenna elements can be set to 70 mm or less. Since the sheet antennas 10A to 10D have flexibility and conform to the shape of the antenna mounting portions, they can be mounted stably and reliably. As is evident from the experimental results, thought the antenna elements are small, they can receive the waves of both the VHF and UHF bands very satisfactorily, and a very-wide-band TV antenna apparatus can be achieved.

[5] In the TV antenna apparatus described in above [4], the main antenna elements include a first antenna element 11 extended along a straight line X in one direction from one point serving as a feed section 16 and gradually broadened to be shaped like a right-angled triangle having long side 11*a* corresponding to the straight line X, and a second antenna element 12 extended in a direction opposite to that of the first antenna element 11 and broadened to be shaped like a right-angled triangle having a long side 12*a* corresponding to the straight line X, and the sub-antenna elements include a third antenna element 12 one end of which is connected to the tip portion of the second antenna element 12 and the other end of which is extended in a zigzag pattern along the straight line X, a fourth antenna element 14 shaped like an oblong card one end of which is connected to the other end of the third antenna element 13, and a fifth antenna element 15 one end of which is connected to the other end of the fourth antenna element 14 and the other end of which is guided into an area E in which 11*c* and 12*c* of the first and second antenna elements 11 and 12 are opposed to each other, the fifth antenna element 15 being extended meanderingly in the area E.

In the TV antenna apparatus described above, since the fifth antenna element 15 is folded to make a U-turn and guided into the area E meanderingly, all the antenna elements are remarkably decreased in the mounting area and can thus be arranged compactly in a narrow area such as the back surfaces of the bumpers 2 and 3.

[6] In the TV antenna apparatus described in above [5], the second antenna element 12 is extended along the straight line X and gradually broadened at a smaller rate of change than that of the first antenna element 11.

According to the foregoing TV antenna apparatus, since the second antenna element 12 is gradually broadened at a smaller rate of change than that of the first antenna element 11, the width of the second antenna element 12 is smaller than that of the first antenna element 11. It is thus easy to secure a space for folding the sub-antenna elements to make a U-turn. Consequently, the sub-antenna elements communicating with the main antenna elements can smoothly be guided into the area E in which the oblique lines 11*c* and 12*c* of the main antenna elements are opposed to each, and a desired pattern can easily be formed.

[7] A TV antenna apparatus according to the embodiment comprises four sheet antennas 10A to 10D serving as an antenna element 10-2 which is obtained by forming a foil having a specific pattern on a base sheet 10-1 constituted of a flexible insulating film, first adhering means for adhering two 10A and 10B of the four sheet antennas 10A to 10D to left or right corners of a front bumper 2 of a vehicle body 1 constituted of nonconductive material, a first low-noise amplifier 18M provided in common to the two sheet antennas 10A and 10B adhered by the first adhering means, a first feeder 19M for connecting the first low-noise amplifier 18M to a TV set 4, a second adhering means for adhering the other two sheet antennas 10C and 10D to right or left corners of a rear bumper 3 of the vehicle body 1 constituted of nonconductive material, and a second feeder 19N for connecting the second low-noise amplifier 18N to the TV set 4.

In the foregoing TV antenna apparatus, the sheet antennas are adhered to two portions, and the number of low-noise amplifiers has only to be two. Therefore, the antenna apparatus can easily be adhered and manufactured at low costs.

Additional advantages and modifications will readily occurs to those skilled in the art. Therefore, the invention in its broader aspects is not limited to the specific details and representative embodiment shown and described herein. Accordingly, various modifications may be made without departing from the spirit or scope of the general inventive concept as defined by the appended claims and their equivalents.

We claim:

1. A TV antenna apparatus for vehicles comprising:

a plurality of flexible sheet antennas serving as an antenna element for receiving a television broadcast wave, which is obtained by forming a foil having a specific pattern on a base sheet constituted of a flexible insulating film;

adhering means for adhering the plurality of flexible sheet antennas only onto inner surfaces of non-conductive front and rear bumpers of a vehicle body;

a low noise amplifier connected to a feed portion of each of the flexible sheet antennas with a matching transformer interposed therebetween for choosing between balanced and unbalanced lines; and feeders formed of a coaxial cable for connecting the low noise amplifier to a TV set.

2. The TV antenna apparatus according to claim 1, wherein each of the sheet antenna includes main antenna elements having a pair of foil patterns, which are extended along a straight line in both directions from a point serving as a feed section and broadened gradually, and which are shaped like right-angled triangles having long sides corresponding to the straight line, and sub-antenna elements, each sub-antenna element having two ends, wherein one end of each sub-antenna element is connected a tip portion of one of the main antenna elements, and the other end of each sub-antenna element is folded to make a U-turn along the straight line and guided into an area in which oblique lines of the antenna elements are opposed to each other.

3. The TV antenna apparatus according to claim 2, wherein the main antenna elements include a first antenna element extended along a straight line in one direction from one point serving as a feed portion and gradually broadened to be shaped like a right-angled triangle having a long side corresponding to the straight line, and a second antenna element extended in a direction opposite to that of the first antenna element and broadened to be shaped like a right-angled triangle having a long side corresponding to the straight line, and each sub-antenna element includes a third antenna element having two ends, wherein one end of the third antenna element is connected to the tip portion of the second antenna element and the other end of the third antenna element is extended in a zigzag pattern along the straight line, a fourth antenna element shaped like an oblong card having two ends, wherein one end of the fourth antenna element is connected to the other end of the third antenna element, and a fifth antenna element having two ends, wherein one end of the fifth antenna element is connected to the other end of the fourth antenna element, and the other end of the fifth antenna element is guided into an area in which of the first and second antenna elements are opposed to each other, the fifth antenna element being extended meanderingly in the area.

4. The TV antenna apparatus according to claim 3, wherein the second antenna element is extended along the straight line and gradually broadened at a smaller rate of change than that of the first antenna element.

5. A TV antenna apparatus for vehicles comprising:

four flexible sheet antennas serving as an antenna element for receiving a television broadcast wave, each of which is obtained by forming a foil having a specific pattern on a base sheet constituted of a flexible insulating film;

adhering means for adhering the four sheet antennas to four positions on inner surfaces of right and left sides of front and rear bumpers formed of a nonconductive member provided on a vehicle body in such a manner that each of the sheet antennas is tightly fitted to a corresponding inner surface by use of the flexibility of the sheet antennas regardless of a shape of the inner surface; and feeders for connecting the four sheet antennas adhered to the bumpers by the adhering means, to a TV set of a four-channel diversity system to allow reception of a wave in the four-channel diversity system.

6. A TV antenna apparatus for vehicles comprising:

a plurality of sheet antennas serving as an antenna element which is obtained by forming a foil having a specific pattern on a base sheet constituted of a flexible insulating film;

adhering means for adhering the plurality of sheet antennas to respective positions of front and rear nonconductive members of a vehicle body; and feeders for connecting the plurality of sheet antennas adhered by the adhering means, to a TV set;

wherein each of the sheet antennas includes main antenna elements having a pair of foil patterns, which are extended along a straight line in both directions from a point serving as a feed section and broadened gradually, and which are shaped like right-angled triangles having long sides corresponding to the straight line, and sub-antenna elements each sub-antenna element having two ends, wherein one end of each sub-antenna element is connected to a tip portion of one of the main antenna elements, and the other end of each sub-antenna element is folded to make a U-turn along the straight line and guided into an area in which oblique lines of the antenna elements are opposed to each other.

7. The TV antenna apparatus according to claim 6, wherein the main antenna elements include a first antenna element extended along a straight line in one direction from one point serving as a feed section and gradually broadened to be shaped like a right-angled triangle having a long side corresponding to the straight line, and a second antenna element extended in a direction opposite to that of the first antenna element and broadened to be shaped like a right-angled triangle having a long side corresponding to the straight line, and each sub-antenna element includes a third antenna element having two ends, wherein one end of the third antenna element is connected to the tip portion of the second antenna element and the other end of the third antenna element is extended in a zigzag pattern along the straight line, a fourth antenna element shaped like an oblong card having two ends, wherein one end of the fourth antenna element is connected to the other end of the third antenna element, and a fifth antenna element having two ends, wherein one end of the fifth antenna element is connected to the other end of the fourth antenna element and the other end of the fifth antenna element is guided into an area in which of the first and second antenna elements are opposed to each other, the fifth antenna element being extended meanderingly in the area.

8. The TV antenna apparatus according to claim 7, wherein the second antenna element is extended along the straight line and gradually broadened at a smaller rate of change than that of the first antenna element.

9. A TV antenna apparatus for vehicles comprising:

four sheet antennas serving as an antenna element which is obtained by forming a foil having a specific pattern on a base sheet comprising a flexible insulating film;

adhering means for adhering the four sheet antennas to respective positions of front and rear nonconductive members of a vehicle body; and feeders for connecting the four sheet antennas adhered by the adhering means, to TV set of a four-channel diversity system to allow reception of wave in the four-channel diversity system;

wherein each of the four sheet antennas includes main antenna elements having a pair of foil patterns, which are extended along a straight line in both directions from a point serving as a feed section and broadened gradually, and which are shaped like right-angled triangles having long sides corresponding to the straight line, and sub-antenna elements, each sub-antenna element having two ends, wherein one end of each sub-antenna element is connected to a tip portion of one of the main antenna elements, and the other end of each sub-antenna element is folded to make a U-turn along the straight line and guided into an area in which oblique lines of the antenna elements are opposed to each other.

10. The TV antenna apparatus according to claim 9, wherein the main antenna elements include a first antenna element extended along a straight line in one direction from one point serving as a feed section and gradually broadened to be shaped like a right-angled triangle having a long side corresponding to the straight line, and a second antenna element extended in a direction opposite to that of the first antenna element and broadened to be shaped like a right-angled triangle having a long side corresponding to the straight line, and each sub-antenna element includes a third antenna element having two ends, wherein one end of the third antenna element is connected to the tip portion of the second antenna element and the other end of the third antenna element is extended in a zigzag pattern along the straight line, a fourth antenna element shaped like an oblong card having two ends, wherein one end of the fourth antenna element is connected to the other end of the third antenna element, and a fifth antenna element having two ends, wherein one end of the fifth antenna element is connected to the other end of the fourth antenna element and the other end of the fifth antenna element is guided into an area in which of the first and second antenna elements are opposed to each other, the fifth antenna element being extended meanderingly in the area.

11. The TV antenna apparatus according to claim 10, wherein the second antenna element is extended along the straight line and gradually broadened at a smaller rate of change than that of the first antenna element.

* * * * *